United States Patent [19]

Weidner

[11] Patent Number: 4,650,394

[45] Date of Patent: Mar. 17, 1987

[54] COOLABLE SEAL ASSEMBLY FOR A GAS TURBINE ENGINE

[75] Inventor: Robert H. Weidner, Glastonbury, Conn.

[73] Assignee: United Technologies Corporation, Hartford, Conn.

[21] Appl. No.: 671,278

[22] Filed: Nov. 13, 1984

[51] Int. Cl.[4] ..... F01D 5/18

[52] U.S. Cl. ..... 415/115; 415/116

[58] Field of Search ..... 415/115, 116, 117, 134, 415/138, 170 R, 216, 217, 180

[56] References Cited

U.S. PATENT DOCUMENTS

| | | | |
|---|---|---|---|
| 2,488,867 | 11/1949 | Judson | 415/136 |
| 2,651,496 | 10/1953 | Buckland et al. | 415/135 |
| 2,787,440 | 4/1957 | Thompson, Jr. | 415/12 |
| 2,847,185 | 8/1958 | Petrie et al. | 415/115 |
| 2,859,934 | 11/1958 | Halford et al. | 415/115 |
| 2,977,090 | 3/1961 | McCarty et al. | 416/96 R |
| 3,085,400 | 4/1963 | Sonder et al. | 416/95 |
| 3,365,172 | 1/1968 | McDonough et al. | 415/117 |
| 3,391,904 | 7/1968 | Albert et al. | 415/170 R |
| 3,411,794 | 11/1968 | Allen | 277/53 |
| 3,575,528 | 4/1971 | Beam, Jr. et al. | 416/34 |
| 3,583,824 | 6/1971 | Smuland et al. | 415/117 |
| 3,588,276 | 6/1971 | Jubb | 416/95 |
| 3,603,599 | 10/1971 | Laird | 277/53 |
| 3,610,769 | 10/1971 | Schwedland | 416/97 R |
| 3,730,640 | 5/1973 | Rice et al. | 415/117 |
| 3,736,069 | 5/1973 | Beam, Jr. et al. | 415/115 |
| 3,742,705 | 7/1973 | Sifford | 60/39.66 |
| 3,752,598 | 8/1973 | Bowers et al. | 415/116 |
| 3,768,818 | 10/1973 | Minegishi | 415/117 |
| 3,814,313 | 6/1974 | Beam, Jr. et al. | 236/93 |
| 3,834,831 | 9/1974 | Mitchell | 416/96 |
| 3,836,279 | 10/1974 | Lee | 415/116 |
| 3,965,066 | 6/1976 | Sterman et al. | 60/39.32 |
| 3,966,356 | 6/1976 | Irwin | 415/217 |
| 4,012,167 | 3/1977 | Noble | 415/115 |
| 4,023,919 | 5/1977 | Patterson | 415/134 |
| 4,127,357 | 11/1978 | Patterson | 415/116 |
| 4,158,526 | 6/1979 | Gerhold et al. | 416/95 |
| 4,337,016 | 6/1982 | Chaplin | 415/116 |
| 4,531,889 | 7/1985 | Grondahl | 416/97 R |

FOREIGN PATENT DOCUMENTS

| | | | |
|---|---|---|---|
| 0034961 | 2/1981 | European Pat. Off. | 415/116 |
| 1258662 | 1/1968 | Fed. Rep. of Germany | 415/116 |
| 1330893 | 9/1973 | United Kingdom . | |
| 1484288 | 9/1977 | United Kingdom . | |
| 1549718 | 8/1979 | United Kingdom | 415/117 |
| 2062119 | 5/1981 | United Kingdom | 415/200 |
| 1600722 | 10/1981 | United Kingdom . | |
| 2081817 | 2/1984 | United Kingdom . | |
| 2117843 | 11/1985 | United Kingdom . | |

*Primary Examiner*—Robert E. Garrett
*Assistant Examiner*—John Kwon
*Attorney, Agent, or Firm*—Gene D. Fleischhauer

[57] ABSTRACT

A coolable seal assembly, such as the outer air seal 26, for a gas turbine engine 10 is disclosed. The seal assembly is formed of a plurality of arcuate seal segments 24 which extend circumferentially about an axis of the engine. The seal segments 24 are spaced apart leaving a clearance gap G therebetween. An orifice plate, such as the orifice plate 94, is disposed in the gap. The orifice plate has an opening, such as the orifice 106, for ducting cooling fluid into the gap G. In one embodiment, the orifice plate is integral with one of the arcuate seal segments and forms a shoulder 128 on the seal segment. Flow through the orifice plate is variably restricted by a device, such as the adjacent seal segment **24*b***, so that the restriction is responsive to the size of the gap G under certain operative conditions of the engine.

15 Claims, 9 Drawing Figures

COOLABLE SEAL ASSEMBLY FOR A GAS TURBINE ENGINE

DESCRIPTION

CROSS REFERENCE TO RELATED APPLICATIONS

This application relates to U.S. application Ser. No. 678,518, filed Dec. 4, 1984 for COOLABLE STATOR ASSEMBLY FOR A ROTARY MACHINE by Robert H. Weidner; U.S. application Ser. No. 684,657, filed Dec. 21, 1984 for COOLABLE SEAL SEGMENT FOR A ROTARY MACHINE by Robert H. Weidner.

TECHNICAL FIELD

This invention relates to gas turbine engines of the type having a flow path for working medium gases. More particularly, the invention is about a seal formed of an array of seal segments that extend circumferentially about an axis of the engine for confining the working medium gases to the flow path. Although the invention was conceived during work in the field of axial flow, gas turbine engines, the invention has application to other fields which employ rotary machines.

BACKGROUND ART

An axial flow, gas turbine engine has a compression section, a combustion section and a turbine section. An annular flow path for working medium gases extends axially through the sections. A stator assembly extends about the annular flow path for confining the working medium gases to the flow path and for directing the gases along the flow path.

As the gases are flowed along the flow path, the gases are pressurized in the compression section and burned with fuel in the combustion section to add energy to the gases. The hot, pressurized gases are expanded through the turbine section to produce work. A major portion of this work is used for useful purposes, such as driving a free turbine or developing thrust for an aircraft.

A remaining portion of the work generated by the turbine section is not used for these purposes. Instead it is used to compress the working medium gases. A rotor assembly extends between the turbine section and the compression section to transfer this work from the turbine section to the compression section. The rotor assembly in the turbine section has rotor blades which extend outwardly across the working medium flow path. The rotor blades have airfoils which are angled with respect to the approaching flow to receive work from the gases and to drive the rotor assembly about the axis of rotation.

An outer air seal circumscribes the rotor blades to confine the working medium gases to the flow path. The outer air seal is part of the stator structure and is formed of a plurality of arcuate segments. The stator assembly further includes an outer case and a structure for supporting the segments of the outer air seal from the outer case. The outer case and the support structure position the seal segments in close proximity to the blades to block the leakage of the gases past the tips of the blades. As a result, the segments are in intimate contact with the hot working medium gases, receive heat from the gases and are cooled to keep the temperature of the segments within acceptable limits.

An initial radial clearance is provided between the seal segments and the tips of the rotor blades to avoid destructive interference between these parts during operation of the engine. The clearance is needed because the outer air seal, the outer case, and the rotor blades move radially at different rates in response to changes in temperature of the hot working medium gases.

The size of the radial clearance depends on the operative conditions of the engine and varies during operation of the engine. To minimize this clearance at cruise or other steady-state operating conditions of the engine, cooling air is discharged against the outer case to cause the case to contract. The contracting case displaces the seal segments inwardly to a smaller diameter and decreases the clearance between the rotor blade tips and the outer air seal with a beneficial effect on engine efficiency.

Examples of such constructions are shown in U.S. Pat. No. 4,019,320 issued to Redinger et al. entitled "Clearance Control For Gas Turbine Engine" and U.S. Pat. No. 4,337,016 issued to Chaplin entitled "Dual Wall Seal Means".

As can be seen in these patents, each seal segment is spaced circumferentially from the adjacent segments leaving a clearance gap G for each pair of segments between the sides of the segments. The clearance gap G for each pair of segments has an initial value $G_{max}$. The initial value $G_{max}$ compensates for tolerance variations, such as variations in segment length caused by manufacturing tolerances, so that as the outer case contracts and forces the outer air seal to a smaller diameter, destructive contact between the sides of segments does not occur. The smallest minimum clearance value $G_{min}$ occurs at the operating condition of the engine which forces the sides of the segments closest together and will likely occur between those pairs of segments having the greatest circumferential length and the smallest inital value $G_{max}$.

As mentioned earlier, the seal segments are cooled to maintain the temperature of the segments within acceptable limits during operation of the engine. In Chaplin, a primary flow path for this cooling air is in flow communication with the seal segments. The outer case, which has passages for the primary flow path, provides an outer boundary for the flow path. A seal means, such as an impingement plate, extends between the working medium flow path and the primary flow path for cooling air to provide an inner boundary to the primary flow path. The impingement plate is spaced from each segment leaving a cavity therebetween. Secondary flow paths, such as a secondary flow path extending through the cavity, direct cooling air to each outer air seal. A plurality of first holes extend through the impingement plate to place the primary flow path in flow communication with the secondary flow path. The first holes precisely meter the flow of cooling air to the secondary flow path. A plurality of second holes extend through each outer air seal segment from the cavity to the radially extending side of one of the segments which bounds the clearance gap G. The holes place the clearance gap G in flow communication with the secondary flow path.

Cooling air is flowed through the primary flow path, the first holes, the secondary flow path in the cavity, and the second holes in the seal segment to the circumferential gap G. The cooling air is at a pressure greater than the pressure of the adjacent working medium flow path to ensure that cooling air flows into the flow path and that working medium gases do not flow into the holes in the seal segments. The size of each second hole determines the flow rate of cooling air through the hole into the gap G for a given operative condition of the engine. Typically, an empirical method is used to determine the hole size. The method includes the step of increasing the size of the holes in each segment until all seal segments are sufficiently cooled during operation of an experimental engine. As a result of tolerance variations, some segments are over cooled in production engines to ensure that all segments in the engine are sufficiently cooled.

The use of cooling air increases the service life of the outer air seal in comparison to uncooled outer air seals. However, the use of cooling air decreases the operating efficiency of the engine because a portion of the engine's useful work is used to pressurize the cooling air in the compressor. A decrease in the amount of cooling air required to provide a satisfactory service life for components such as the outer air seal increases the work available for other purposes, such as providing thrust or powering a free turbine, and increases the overall engine efficiency.

Accordingly, scientists and engineers are seeking to more efficiently supply cooling air to components such as outer air seal segments and to minimize the overcooling of such components.

DISCLOSURE OF INVENTION

According to the present invention, a gas turbine engine of the type having a plurality of arcuate seal segments which extend circumferentially about an axis of the engine to bound a working medium flow path and which are spaced apart to leave a clearance gap G therebetween also includes an orifice plate disposed in the gap between segments and a means for variably restricting flow through the orifice plate that is responsive to the size of the gap.

In accordance with one embodiment of the present invention, the orifice plate is integral with one segment of a pair of segments and the means for variably restricting flow is integral with the other segment.

This invention is based in part on the realization that the amount of cooling fluid needed to cool the clearance gap G increases as the size of the gap increases and decreases as the size of the gap decreases and that the greatest amount of cooling air is required between those pairs of segments whose sides are furthest apart during operating of the engine such as might occur between those pairs of segments having the largest value of $G_{max}$, the least circumferential length and at that operative condition of the engine which causes the diameter of the outer air seal and relative thermal growth between segments to force the segments furthest apart.

A primary feature of the present invention is a seal for a working medium flow path of a gas turbine engine which is formed of an array of arcuate seal segments extending circumferentially about an axis of the engine. Each arcuate seal segment is spaced circumferentially from an adjacent arcuate seal segment leaving a clearance gap G therebetween. Another feature of the present invention is an orifice plate disposed in the gap G which extends between the seal segments. The orifice plate has an opening for cooling fluid. Another feature is a means for variably restricting the flow of cooling air through the opening in the orifice plate. In one embodiment, the orifice plate is integral with one segment of a pair of segments. The other segment of the pair of segments variably restricts the flow through the opening. In another embodiment, a second plate disposed outwardly of the orifice plate forms a manifold which is in flow communication with the openings in the orifice plate.

A primary advantage of the present invention is the engine efficiency which results from metering the flow of cooling air to the clearance gap G such that the flow of cooling air is responsive to the size of the gap G. Another advantage is the effective use of the cooling air by providing a radial component of velocity to the cooling air to cause the cooling air to move radially outwardly in the gap G. In one embodiment, an advantage is the cooling effectiveness which results from the circumferential and radial components of velocity which urges the cooling air outwardly toward the intermediate layer of the adjacent outer air seal segment.

The foregoing features and advantages of the present invention will become more apparent in light of the following detailed description of the best mode for carrying out the invention and in the accompanying drawings.

BEST MODE FOR CARRYING OUT THE INVENTION

Figure 1:
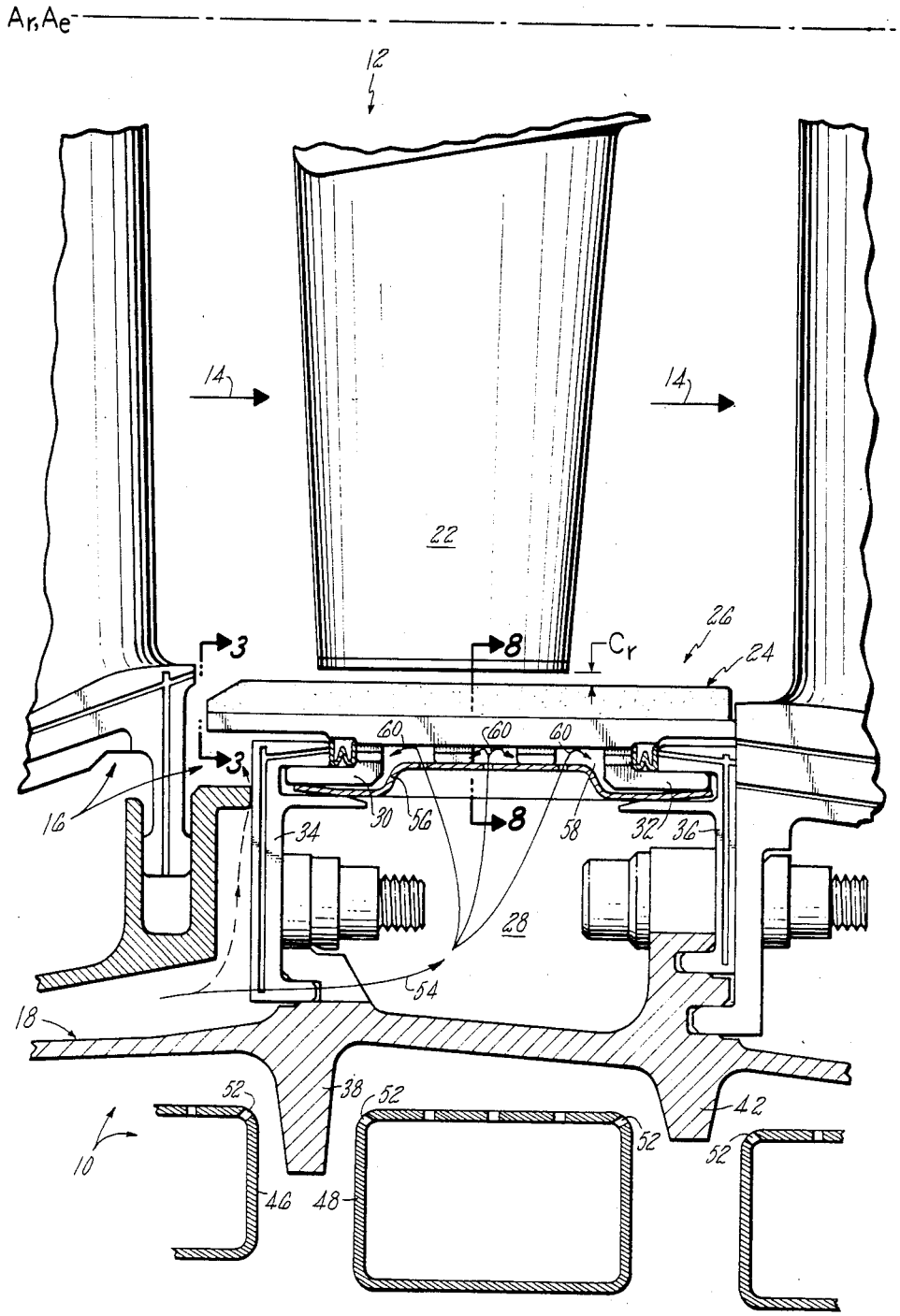
FIG. 1 is a simplified cross-sectional view of a portion of a gas turbine engine showing a turbine blade of an array of turbine blades and an arcuate seal segment of an outer air seal which extends circumferentially about the array of turbine blades.

FIG. 1 is a side elevation view of an axial flow gas turbine engine 10 which shows a portion of a turbine section 12 and an axis of rotation $A_r$ of the engine. The turbine section includes an annular flow path 14 for working medium gases which is disposed about the axis $A_r$. A stator assembly 16 bounds the working medium flow path. The stator assembly includes an outer case 18. The outer case extends circumferentially about the working medium flow path. A plurality of rotor blades, as represented by the single rotor blade 22, extend radially outwardly across the working medium flow path into close proximity with the outer case.

A stator structure formed of a plurality of arcuate seal segments, as represented by the single seal segment 24, extends about an axis $A_e$ to bound the annular flow path 14. In the embodiment shown, the arcuate seal segments form an outer air seal 26 which circumscribes the tips of the rotor blades 22. The outer air seal is spaced radially from the rotor blade 22 by a variable clearance $C_r$ to accommodate relative radial movement between the rotor blade and the outer air seal. The outer air seal is spaced radially inwardly from the outer case leaving a circumferentially extending cavity 28 therebetween.

Each arcuate seal segment 24 is adapted by an upstream hook 30 and a downstream hook 32 to engage supports, such as upstream support 34 and downstream support 36, which extend inwardly from the outer case. The supports are attached to the outer case to support and position the outer air seal 26 in the radial direction about the rotor blades. Each support may be segmented to reduce the hoop strength of the support.

An upstream rail 38 extends circumferentially about the outer case adjacent to the upstream support 34. A downstream rail 42 extends circumferentially about the outer case adjacent to the downstream support 36. A means for impinging cooling air, such as cooling air tube 46 and cooling air tube 48, extends circumferentially about the rails. The tubes are in flow communication with a source of cooling air (not shown) and are adapted by holes 52 to impinge cooling air on the rails.

A first flow path 54 for cooling air extends inwardly of the outer case 18. The first flow path is bounded by the outer case 18 and extends through the engine outwardly of the working medium flow path 14. The flow path extends into the cavity 28 between the outer air seal 26 and the outer case. A circumferentially extending impingement plate 56 is trapped between the outer air seal and the upstream and downstream supports 34, 36. The impingement plate bounds the cavity 28 and is spaced radially from the outer air seal to form a second cavity 58. A secondary flow path, such as the second flow path 60 for cooling air extends axially and circumferentially beneath the outer air seal in the cavity 58. A plurality of impingement holes 62 in the impingement plate places the first flow path 54 in flow communication with the second flow path 60.

Figure 2:
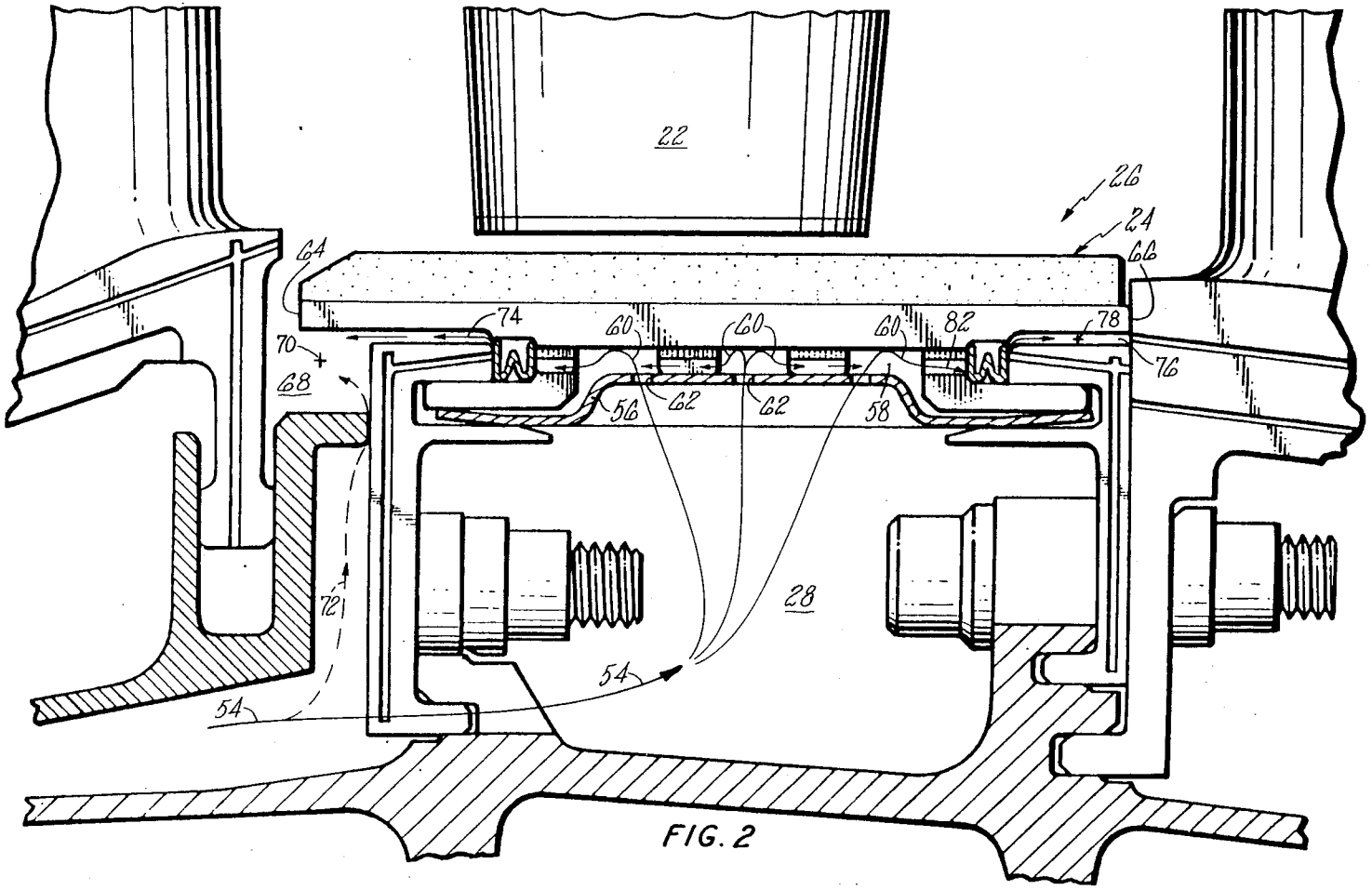
FIG. 2 is an enlarged view of a portion of FIG. 1.

As shown in FIG. 2, each seal segment 24 of the outer air seal 26 has a leading edge 64 and a trailing edge 66. The leading edge is spaced radially from an adjacent portion of the stator assembly leaving a circumferentially extending cavity 68 therebetween. The cavity forms a third flow path 70 for cooling air which extends axially and circumferentially beneath the leading edge region. A leak path 72 extends through tolerance gaps and between adjacent seal segments. The leak path 72 places the cavity 68 and the third flow path 70 in flow communication with the first flow path 54. At least one vent path 74 extends between the cavity 68 and the cavity 58 to place the third flow path 70 in flow communication with the second flow path 60.

The trailing edge region 66 is spaced radially from the adjacent stator structure leaving an annular cavity 76 therebetween. The annular cavity 76 extends circumferentially beneath the array of outer air seal segments and forms a fourth flow path 78 for cooling air which extends in the circumferential and radial directions. At least one vent path 82 extends between the second cavity 58 and the cavity 76 to place the flow path 60 in flow communication with the fourth flow path 78.

Figure 3:
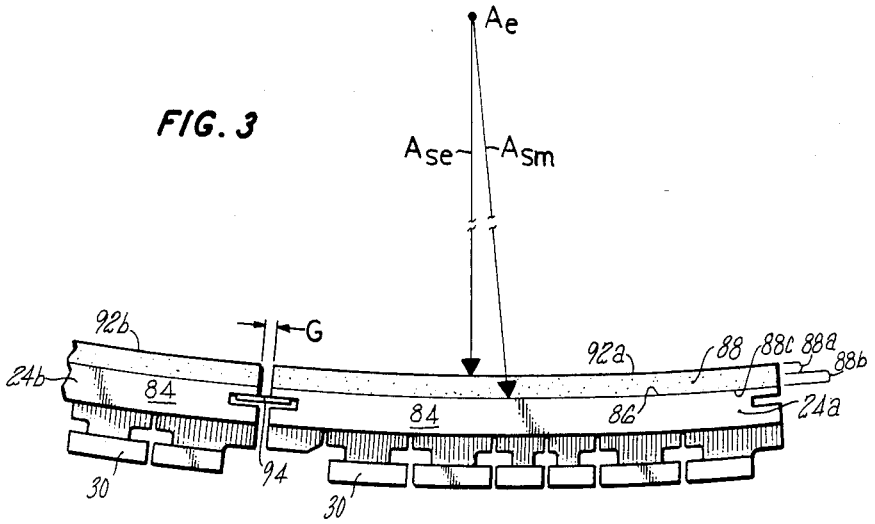
FIG. 3 is an end view of a pair of adjacent arcuate seal segments taken along the lines 3—3 of FIG. 1.

FIG. 3 is a front view of the outer air seal taken along the lines 3—3 of FIG. 1 to show a pair of adjacent arcuate seal segments 24 (that is, seal segment **24*a* and seal segment 24*b*). Each seal segment has a metallic form 84. The metallic form has a surface 86 which extends circumferentially about the axis $A_{sm}$. The upstream hooks 30 and the downstream hooks 32 (not shown) extend outwardly from the metallic form. A ceramic facing material 88 is attached to the metallic form. The ceramic facing material has a ceramic surface layer 88*a* and a ceramic metal intermediate layer 88*b* which, with an associated bond layer 88*c*, attaches the ceramic layer to the metallic form. The ceramic facing material has an arcuate sealing surface 92 as represented by the arcuate sealing surface 92*a***, which extends circumferentially about the axis $A_{se}$. In the embodiment shown, these two axes of the segment $A_{sm}$ and $A_{se}$, are coincident with the axis $A_e$ of the engine.

The second seal segment **24*b* is spaced circumferentially from the first seal segment 24*a* leaving a circumferential gap G therebetween. The gap G varies in size under operative conditions of the engine. An orifice plate 94** is disposed in the gap G and extends axially between the segments and laterally across the circumferential width of the gap G. The lateral width and the circumferential width of the gap are equivalent because the radius of curvature is nearly 150 times greater than the maximum width of the gap G. Accordingly, the terms "circumferentially extending" and "laterally extending" are used interchangeably.

Figure 4:
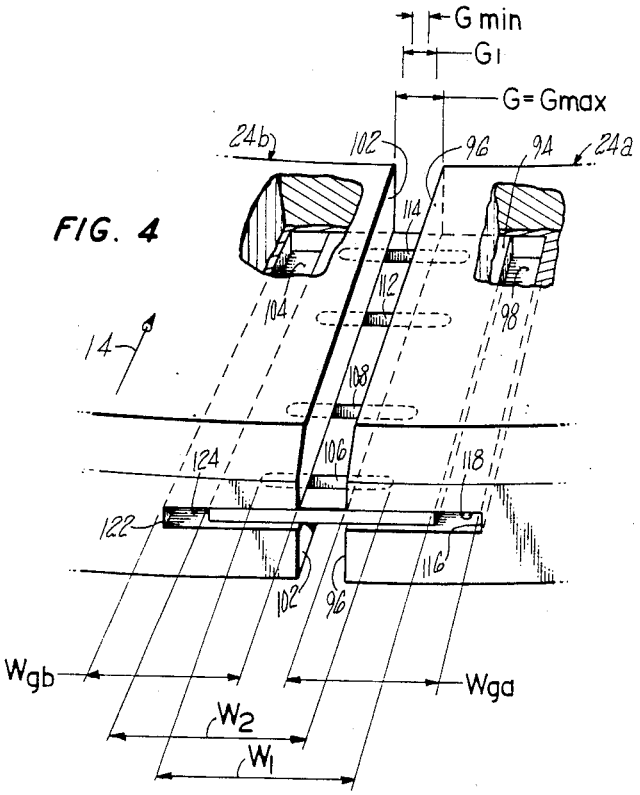
FIG. 4 is a simplified partial perspective view similar to the view taken in FIG. 3 of the embodiment shown in FIG. 3 with portions of the adjacent pair of arcuate segments broken away for clarity.

FIG. 4 is a simplified perspective view of the first seal segment **24*a* and the second seal segment 24*b*. Portions of the segments are broken away to show the relationship of the seal segments to the orifice plate 94 under an operative condition at which the gap G has a maximum value $G_{max}$. The first seal segment 24*a* has a first side 96 which bounds the gap G. The first side 96 has a first axially oriented groove 98. The second seal segment has a first side 102 facing the first side 96. The first side 102 bounds the gap G and has an axially oriented groove 104 which faces the groove 98 in the first seal segment. The orifice plate is disposed in the facing grooves 98, 104**.

As shown, the orifice plate 94 has openings such as a first orifice 106, a second orifice 108, a third orifice 112 and a fourth orifice 114. These orifices extend in a substantially radial direction. The first orifice is in flow communication with the cavity 68 and its flow path 70 for cooling air and thence with the first flow path 54 for cooling air and the second flow path 60 for cooling air. The second orifice 108 and the third orifice 112 are directly in flow communication with the second flow path 60. The fourth opening 114 is in flow communication with the cavity 76 and its flow path 78 for cooling air and thence with the second flow path 60.

The groove in the first segment includes a first wall 116 and a first surface 118 extending between the first wall and the first side 96. The groove in the second segment has a first wall 122 and a first surface 124 extending between the first wall and the first side 102. These surfaces adapt the segments to overlap the orifices under at least one operative condition of the engine. In the design shown, the segments will always overlap the orifice 106. This occurs because of two constraints. First, the distance $W_1$ from the right (first) side of the orifice plate to the left (second) end of the orifice 106 is greater than the summation of the distance $W_{ga}$ from the first wall 116 of the first segment to the first side 96 of the first segment and $G_{max}$, that is, $W_1$ is greater than the summation of $W_{ga}$ and $G_{max}$ ($W_1 > W_{ga} + G_{max}$). Secondly, the distance $W_2$ from the left (second) side of the orifice plate to the right (first) end of the orifice 106 is greater than the summation of $W_{gb}$ and $G_{max}$ ($W_2 > W_{gb} + G_{max}$). As a result, the surface 118 of the first seal segment and the surface 124 of the second seal segment adapt the first and second seal segments to overlap the orifice under all operative conditions of the engine.

Figure 5:
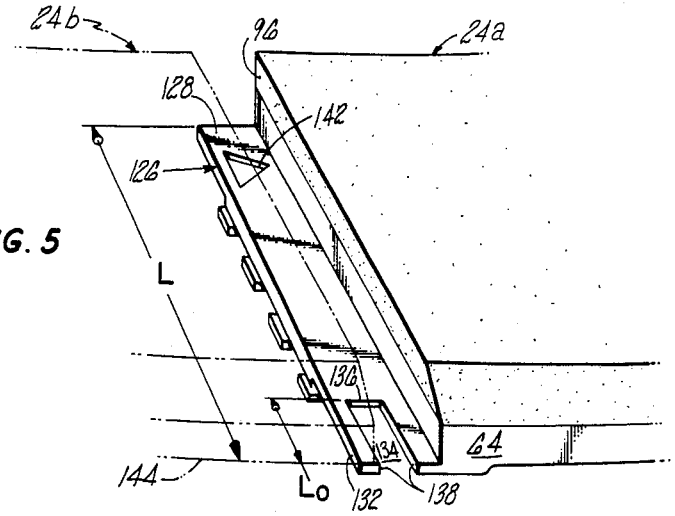
FIG. 5 is a partial perspective view similar to FIG. 4 of an alternate embodiment of the structure as shown in FIG. 1 and FIG. 4.

FIG. 5 is a partial perspective view similar to FIG. 3 of an alternate embodiment of the structure shown in FIG. 1 and FIG. 3 having an orifice plate 126 that is integral with the first seal segment. The orifice plate forms a shoulder 128 on the first seal segment. The shoulder 128 extends from the first side 96 of the first seal segment and has a first wall 132 which is substantially parallel to the first side. A first orifice 134 lies between the first wall and the first side of the first seal segment. The first orifice 134 extends rearwardly from the leading edge 64 of the segment for a distance $L_o$ equal to approximately ten percent of the axial length L of the segment. The orifice is bounded by a first edge 136 on the shoulder which is substantially perpendicular to the first side and two second edges 138 which are substantially parallel to the first side to form a rectangular notch-like shape.

The first orifice 134 is in flow communication with the cavity 68 and its third flow path 70 beneath the leading edge region and thence through the intermediate paths 72 and 74 with the first flow path 54 and second flow path 60 for cooling air. The orifice plate has a second orifice 142. The orifice is triangular in shape to provide an overlap of the opening by a surface 144 which varies non-linearly with a change the size of the gap G during operation of the engine. In this embodiment, the second seal segment **24*b* provides the second surface 144** which overlaps the first orifice and the second orifice.

Figure 6:
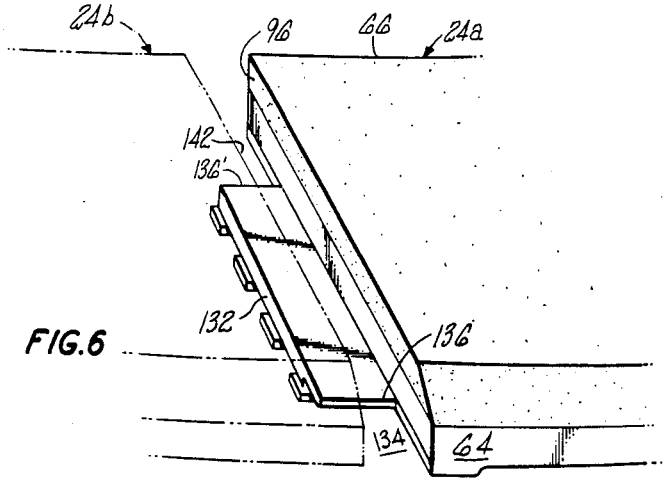
FIG. 6 is a partial perspective view of an alternate embodiment of the embodiment shown in FIG. 5.

FIG. 6 is a partial perspective view of an alternate embodiment of the embodiment shown in FIG. 5 having a rectangular opening 134 in shoulder 128. The opening extends from the first side 96 to the first wall 132 and from the first edge 136 to the leading edge 64 such that the overlap of the opening by the adjacent seal segment is continuously variable as the gap G varies. The second opening 142 is a rectangular opening like the first opening 134 and extends from the first edge 136' to the trailing edge 66.

Figure 7:
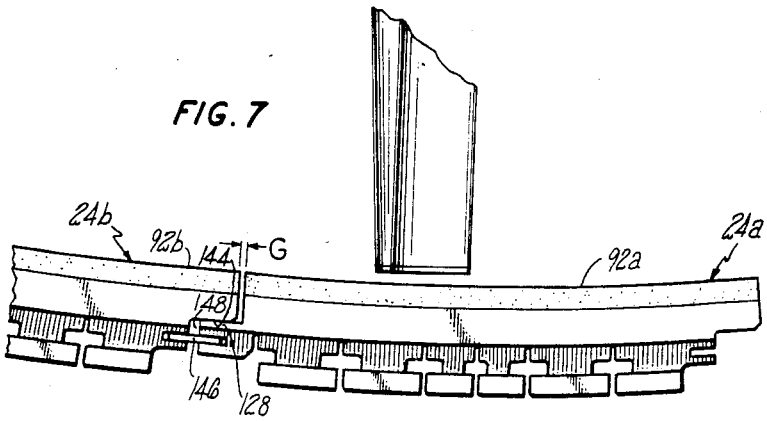
FIG. 7 is a view similar to FIG. 3 of an alternate embodiment of the embodiment as shown in FIG. 1 and FIG. 3.

FIG. 7 is an alternate embodiment of the structure shown in FIG. 6 having a second plate 146 and a first plate 128 which is an integral shoulder on the first segment. The shoulder has at least one opening (not shown) to regulate the flow of cooling air into the gap G. The second plate is spaced radially from the second segment **24*b* leaving a manifold 148 in endwise flow communication with the cavity 68** for ducting cooling air rearwardly. As shown, the second plate has no openings extending through the plate.

Figure 8:
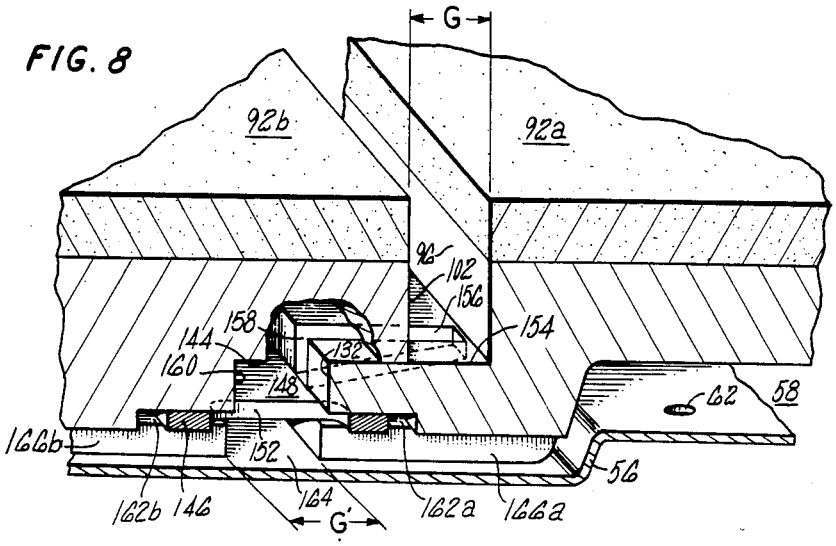
FIG. 8 is a partial perspective view of the embodiment shown in FIG. 7 taken generally along the lines 8—8 of FIG. 1 with portions removed for clarity.

FIG. 8 is an alternate embodiment of the structure shown in FIG. 7 which has a second plate 146 having openings, as represented by the single opening 152. The first plate 128 is an integral shoulder of the first seal segment **24*a*. A shoulder surface 154 on the first plate extends from the first side 96 to the first wall 132. The shoulder surface 154 faces the working medium flow path. An opening 156 extends between the first wall and the first side. A passageway 158 extends from the manifold 148** to the gap G for supplying cooling fluid to the gap.

The first side 102 of the second seal segment **24*b* extends axially along the second segment adjacent to the sealing surface 92*b*. The first side of the second seal segment is spaced circumferentially from the first side of the first seal segment 92*a* leaving the gap G therebetween. The second seal segment has a first wall 160 which is spaced circumferentially from the first wall of the first seal segment leaving a gap G' therebetween. The first wall 160 is spaced circumferentially from the first side 102 of the second segment. The second surface 144 extends between the first wall and the first side to form a recess. The second surface 144 overlaps the shoulder surface 154 of the first segment and extends over the opening 156** in the first segment.

The first wall 132 of the first segment **92*a* and the first wall 160 of the second segment have axially oriented grooves 162*a* and 162*b* as do the sides of the arcuate seal segments shown in FIG. 4. The second plate 146 is disposed in the gap G' and extends axially between the segments, across the gap G' and into the facing grooves. The second plate and the walls 132, 160 define a plenum 164 extending axially between the walls and inwardly of the second plate. Slots 166*a* and 166*b* in the segments 24*a* and 24*b* place the plenum 164 in flow communication with the secondary flow path 60 for cooling air in cavity 58 and thence through holes 62 with the flow path 54** for cooling air.

Figure 9:
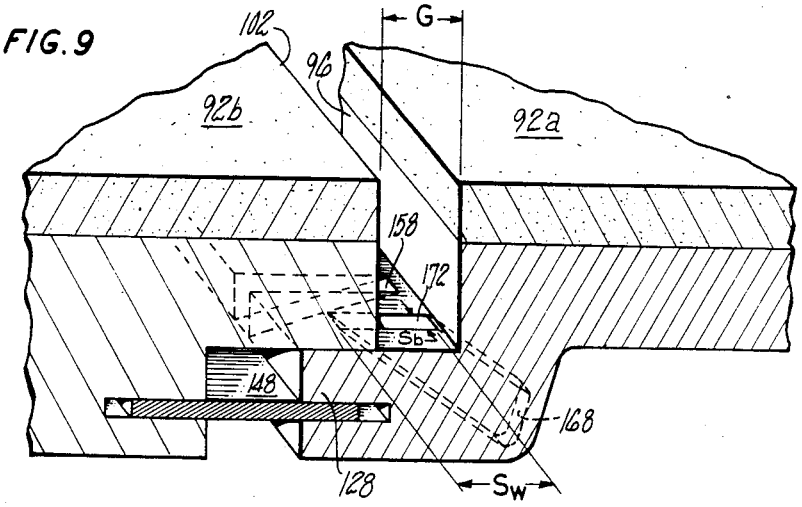
FIG. 9 is an alternate embodiment of the view shown in FIG. 8.

FIG. 9 is an alternate embodiment of the structure shown in FIG. 8 which has a second passageway 168. The second passageway has an opening 172 and extends from the opening through the shoulder 128 to place the gap G in flow communication with the second flow path 60 for cooling air. The opening has a circumferential width $S_w$ and an axial length $S_b$ such that the width is at least three times greater than the length to form a narrow, rectangular opening. The second passageway is angled with respect to the surface 154 of the shoulder to direct the flow of cooling air with a component of velocity in the radial direction and a component of velocity in the circumferential direction toward side 102 of the second segment. In addition, the first passageway 158 may alternate with the second passageway to direct the cooling air with both a circumferential and radial direction of velocity toward and against the other side 96 bounding the gap G under operative conditions of the engine.

As shown in FIG. 1, during operation of the gas turbine engine 10, cooling air and hot working medium gases are flowed into the turbine section 12 of the engine. The hot working medium gases are flowed along the annular flow path 14. Cooling air is flowed along the first flow path 54 and enters the turbine section outwardly of the hot working medium flow path. Components of the turbine section, including the outer case 18, the outer air seal 26, and the upstream and downstream supports 34, 36 for the outer air seal are heated by the working medium gases and cooled by the cooling air.

These components of the engine respond thermally at different rates to heating by the working medium gases and to cooling by the cooling air. Factors affecting their thermal response include the thermal capacitance of the components and the exposure of the components to hot gases and to cooling air. For example, components such as the outer air seal 26 and the upstream and downstream supports 34, 36 are closer to the working medium flow path than is the outer case 18. In addition, the outer air seal and the upstream and the downstream supports have a thermal capacitance that is smaller than the outer case. As a result, the outer air seal and the upstream and downstream supports respond more quickly to changes in gas path temperature than does the outer case. An increase in the temperature of the hot working medium gases, such as occurs during acceleration and start-up, causes the outer air seal and the supports to expand, decreasing the circumferential gap G between the adjacent arcuate seal segments 24.

As shown in FIG. 3 and FIG. 4, an initial clearance $G_{max}$ is provided to each pair of arcuate seal segments 24*a*, 24*b* of the outer air seal to accommodate this relative growth. The initial clearance takes into account tolerance variations between the arcuate seal segments to ensure that even two adjacent segments of maximum length have a sufficient gap $G_{min}$ between the segments after the maximum amount of relative thermal growth to avoid destructive abutting contact between the segments as the clearance gap G varies.

Several sources of cooling air are in flow communication with the circumferential gap G. As shown in FIG. 2, these sources of cooling air include the second annular cavity 58 between the impingement plate 56 and the seal segment 24, the third annular cavity 68 at the forward portion of the sealing segment and the fourth annular cavity 76 at the rear portion of the sealing segment. The third annular cavity 68 collects a portion of the cooling air which leaks from the first flow path 54 along the leak path 72 and collects cooling air from the vent path 74 from the second cavity 58. The collected cooling air in cavity 68 is flowed along the third flow path 70 which extends circumferentially and radially about the interior of the engine.

As shown in FIG. 2 and FIG. 4, a portion of the cooling air collected in cavity 68 is directed with a radial component of velocity to the gap G through the orifice plate 94 via opening 106. The second cavity 58 between the impingement plate 56 and the arcuate seal segment 24 collects cooling air which is impinged on the seal segment and provides the cooling air to vent paths 74 and 82 and to openings 108 and 112 in the orifice plate 94. The portion of the cooling air which is flowed through the orifice plate via openings 108 and 112 is directed to the gap G with a radial component of velocity. The fourth annular cavity 76 collects a portion of cooling air from the vent path 82. The collected cooling air is flowed along the fourth flow path 78 which extends circumferentially and radially about the interior of the engine. The portion of the cooling air flowed through the orifice plate via the fourth opening 114 is directed to the gap G with a radial component of velocity.

As the working medium gases are flowed along the annular flow path outwardly of the rotor blades, the gases tend to sweep the cooling air through the gap G and to push the cooling air outwardly toward the orifice plate 94. The orientation of the openings and the flow of air through the openings provides a radial component of velocity to the cooling air. The velocity of the cooling air in the radial direction imparts a momentum to the cooling air that causes a column of cooling air to extend radially inwardly in the gap G, counteracting the pushing, sweeping effect of the working medium gases and providing cooling to the critical region of the seal segments which is located at the intermediate layer 88*b* of ceramic facing material 88 adjacent to the metal form 84.

As shown in FIG. 4, the clearance gap G has a value $G_1$ under operative conditions which lies between the minimum value $G_{min}$ and the maximum value $G_{max}$. The amount of cooling air needed to adequately cool the walls of the segments adjacent to the gap is proportional to the gap size. Thus, as the gap increases in size, more cooling air is needed to adequately cool the components. Correspondingly, even with no change in the temperature of the working medium gases, as the gap decreases in size, less cooling air is needed to provide adequate cooling to the adjacent seal segments.

The adjacent sealing segment 24*a* and 24*b* provide a means for variably restricting the flow of the cooling air through each opening in the orifice plate to meter the flow of cooling air to the gap G. As mentioned earlier, the pressure of the cooling air in the third annular cavity 68, the second cavity 58 and the fourth annular cavity 76 is higher than the pressure of the gases in the working medium flow path and results in a difference in pressure across the orifice plate 94. The difference in pressure results in a force which urges the orifice plate outwardly against the first surface 118 on the first sealing segment 24*a* and the first surface 124 on the second sealing segment 24*b* causing the sealing segments to each slidably engage the orifice plate. As the surfaces 118, 124 move circumferentially with respect to the openings 106, 108, 112 and 114, the amount of restriction of the orifices varies directly with the amount of overlap. Thus, the sealing segments themselves through the surfaces 118 and 124 provide a means for variably restricting flow through the openings in the orifice plate.

The surface 118 is integral with the side 96 of the first segment 24*a* and the surface 124 is integral with the side 102 of the second segment 24*b*. Because the sides 96, 102 define the gap G, the surfaces have a position relative to the opening which is responsive to the size of the gap G as the gap G changes. Therefore, the construction provides a means for variably restricting the flow of cooling air to the gap to meter the flow of cooling air in a way that is responsive to the size of the gap G.

Metering the flow of cooling air to more closely match the requirement for cooling air has a beneficial effect on engine efficiency and on the service life of components. For example, the flow of cooling air is increased under operating conditions during which the gap G increases in size to ensure that additional cooling air which is needed to cool the wider gap is supplied to the gap. This results in increased service life or engine efficiency in comparison with constructions where the flow of cooling air to the gap is a constant amount. As the gap decreases, the surfaces move closer together blocking a larger portion of the openings to decrease the flow of cooling air to the amount that is required to sufficiently cool the smaller gap. A more efficient engine results in comparison with constructions that supply a constant amount of cooling air to the gap even though the need for cooling air decreases.

FIG. 5 is an alternate embodiment of the invention shown in FIG. 4 which has an orifice plate formed as an integral shoulder 128 on the segment 24*a*. The shoulder has an opening 134 which is a rectangular slot in the leading edge region 64. The slot is in flow communication with the third annular cavity 68 shown in FIG. 2 in the same way that the first opening 106 shown in FIG. 4 is in flow communication with the cavity 68. Relative movement between the first seal segment 24*a* and the second seal segment 24*b* causes a substantially linear variation in the flow of cooling air through the opening until the segment completely overlaps the opening. Alternatively, the slot might have a tailored shape, such as a triangular shape shown in the opening 142, to tailor the flow in a substantially nonlinear way as the overlap of the segments changes.

FIG. 6 is an alternate embodiment of the construction shown in FIG. 5 having a slot-like orifice 134 which extends from the leading edge 64 rearwardly and a slot-like orifice 142 which extends from the trailing edge forwardly. As in the FIG. 4 and FIG. 5 embodiments, cooling air is flowed through the opening with a radial component of velocity. In the trailing edge region, the cooling air has a radial component of velocity which aids in deflecting the flow of the hot, working medium gases away from the slot at a point upstream of the trailing edge.

As shown in FIG. 7, a second plate 146 extending between the seal segments 24*a* and 24*b* further controls the flow of cooling air in the radial direction between the adjacent sealing segments. The second plate may be provided with a plurality of orifices as shown in FIG. 8 or with no orifices as is the plate shown in FIG. 7. In either embodiment the second plate is urged radially inwardly by the pressure of the cooling air radially outwardly of the plate to engage the adjacent seal segments.

As shown in FIG. 8, cooling air is flowed from cavity 58 via slots 166*a* and 166*b* to manifold 164 and thence through metering openings 152 to the inner manifold 148. Slots 158 in the shoulder 138 further meter the cooling air to the gap G. The cooling air has a component of velocity $V_r$ in the radial direction and a component of velocity $V_c$ in the circumferential direction. The component of velocity in the circumferential direction causes the cooling air to impinge on the sides of the outer air seal.

FIG. 9 is an alternate embodiment of the constructions shown in FIG. 7 and FIG. 8 and includes a plurality of passageways 168 which extend through the first seal segment 24*a* to the second cavity 58. The manifold 148 is in flow communication at the leading edge region 64 with the third annular cavity 68. The passageway 158 places the manifold 148 in flow communication with the gaps and provides a radial component of velocity and a circumferential component of velocity for directing cooling air towards the side 96 of the first segment. Cooling air flowed through the passageway 168 also has a component of velocity in the radial direction and a circumferential component of velocity which urges the cooling air toward the side 102 of the second segment 24*b*. As a result, cooling air is directed toward the sides 96, 102 which bound the gap G. Although the invention has been shown and described with respect to detailed embodiments thereof, it should be understood by those skilled in the art that various changes in form and detail thereof may be made without departing from the spirit and the scope of the claimed invention.

I claim:

1. In a gas turbine engine of the type having an axis A, an annular flow path for working medium gases, a flow path for cooling fluid spaced radially from the working medium flow path and a plurality of arcuate seal segments extending circumferentially about the axis to bound the working medium flow path, the plurality of arcuate seal segments having at least one pair of arcuate seal segments which includes a first seal segment and a second seal segment that is spaced circumferentially from the first seal segment leaving a gap G therebetween that varies in size during operative conditions, the improvement which comprises:

an orifice plate disposed in said gap which extends axially between the pair of segments and across the gap G and which has an opening in flow communication with the flow path for cooling fluid for directing cooling air through the orifice plate and into the radial gap G at a location which is upstream of a portion of the orifice plate with a radial component of velocity, and means for variably restricting the flow through said opening which is adapted to variably overlap said opening under operative conditions and which has a position relative to said opening which is responsive to the size of the gap G.

2. The gas turbine engine of claim 1 wherein the orifice plate slidably engages one of said pair of seal segments under operative conditions.

3. The gas turbine engine of claim 1 wherein the first seal segment has a first side which bounds the gap G and has an axially oriented groove in the first side, wherein the second seal segment has a first side which bounds the gap G and has an axially oriented groove which faces the groove in the first seal segment, wherein the orifice plate is disposed in said grooves and urged outwardly under operative conditions against the segments to slidably engage the segments in the circumferential direction, and wherein the means for variably restricting the flow includes one of the segments which is adapted to overlap the opening under at least one operative condition of the engine.

4. The invention as claimed in claim 1 wherein the orifice plate is integral with said first seal segment and forms a shoulder on said first seal segment.

5. The invention as claimed in claim 4 wherein the first seal segment has a leading edge, a trailing edge spaced a length L from the leading edge, and a first side which is axially oriented and which extends from the leading edge to the trailing edge, wherein the shoulder projects from the first side and has an axially oriented first wall spaced circumferentially from the first side, and wherein the opening extends circumferentially from the first side to the first wall and in the axial direction from one of said edges for a length $L_o$ equal to or greater than ten percent of the length L, ($L_o \geqq 0.10L$).

6. The invention as claimed in claim 5 wherein the opening extends in the axial direction from the leading edge.

7. The invention as claimed in claim 4 wherein the second seal segment has a first side facing the first side of the first seal segment, wherein the opening has a circumferential width $S_w$ and an axial length $S_b$, wherein the width $S_w$ is at least three times greater than the length $S_b$, wherein the arcuate segments form an outer air seal extending circumferentially about the working medium flow path and bound the flow path for cooling fluid and wherein a passageway extends through the shoulder to place the opening in fluid communication with the flow path for cooling fluid and is angled with respect to the surface of the shoulder to direct the flow of cooling fluid with a component of velocity in the radial direction and a component of velocity in the circumferential direction toward one of said sides.

8. For an axial flow gas turbine engine having an annular flow path for working medium gases and a flow path for cooling air spaced radially from the working medium flow path, a structure for bounding the working medium flow path, which comprises:

a plurality of arcuate seal segments extending circumferentially about the working medium flow path, each segment being spaced circumferentially from the adjacent segment leaving a circumferential gap G therebetween, the plurality of arcuate seal segments including a first seal segment which has a sealing surface facing the working medium flow path, a first side adjacent to the sealing surface and extending axially along the first segment, a projection extending from the first side to form a shoulder having a first wall spaced circumferentially from the first side, a shoulder surface extending between the first side and the first wall and facing the working medium flow path, and, a second seal segment which has a sealing surface facing the working medium flow path, a first side which extends axially along the second segment and which is spaced circumferentially from the first side leaving the gap G therebetween, and, a second surface which overlaps the shoulder surface of the first segment;

wherein the first seal segment has at least one opening which extends between the first wall and the first side for supplying a cooling fluid to the gap G, the opening being bounded by the shoulder surface of the first segment and overlapped by the second surface of the second segment under at least one operating condition of the engine such that an increase in the size of the gap G decreases the overlap and increases the flow of cooling fluid through the opening and a decrease in the size of the gap G increases the overlap and decreases the flow of cooling fluid through the opening.

9. The structure as claimed in claim 8 wherein the first segment has an axially oriented groove in the first wall of the first segment, wherein the second seal segment has a first wall which extends from the second surface of the second seal segment, which is spaced circumferentially from the first side of the second seal segment to form a recess, and which is spaced circumferentially from the first wall of the first segment leaving a gap G′ therebetween, the first wall of the second seal segment further having an axially oriented groove which faces the axially oriented groove in the first wall of the first segment, wherein the structure further includes a second plate disposed in the gap G′ which extends axially between the segments, across the gap G′ and into the facing grooves to define a plenum extending axially between the walls and inwardly of the second plate which is in flow communication with the flow path for cooling air and wherein the first seal segment has a passageway in flow communication through the opening in the first seal segment with the gap G and in flow communication with the plenum such that the plenum acts as a manifold to distribute the cooling fluid to any openings in fluid communication with the gap G.

10. The structure as claimed in claim 9 wherein the second plate is a second orifice plate having at least one orifice in flow communication with said plenum and with the flow path for cooling air for metering the flow of cooling fluid into the axially extending plenum.

11. The structure as claimed in claim 10 wherein at least one of the segments overlaps the orifice in the second orifice plate under at least one operating condition of the engine.

12. The structure as claimed in claim 11 wherein said passageway which is in flow communication with the gap is radially oriented.

13. An arcuate seal segment which has a sealing surface facing in a first direction having curvature about an axis, a first side adjacent to the sealing surface and extending axially along the first segment, a projection extending from the first side to form a shoulder having a first wall spaced circumferentially from the first side, a shoulder surface which faces the axis extending between the first side and the first wall and at least one opening which extends between the first wall and the first side, the opening being bounded by the shoulder surface.

14. The arcuate seal segment of claim 13 wherein the seal segment has a leading edge, a trailing edge spaced a length L from the leading edge, wherein the first side extends from the leading edge to the trailing edge and wherein the opening extends circumferentially from the first side to the first wall and in the axial direction from one of said edges for a length $L_o$ equal to or greater than ten percent of the length, L, ($L_o > 0.10L$).

15. The arcuate seal segment of claim 13 wherein the opening is triangular in shape and is bounded by an edge which bounds the base of the triangular shape and which is parallel to the wall.

* * * * *